US007978149B2

(12) United States Patent
Chang et al.

(10) Patent No.: US 7,978,149 B2
(45) Date of Patent: Jul. 12, 2011

(54) DIELECTRIC RESONATOR ANTENNA WITH BENDING METALLIC PLANES

(76) Inventors: Tze-Hsuan Chang, Taipei (TW); Jean-Fu Kiang, Taipei (TW)

( * ) Notice: Subject to any disclaimer, the term of this patent is extended or adjusted under 35 U.S.C. 154(b) by 697 days.

(21) Appl. No.: 12/038,243

(22) Filed: Feb. 27, 2008

(65) Prior Publication Data

US 2009/0102739 A1 Apr. 23, 2009

(30) Foreign Application Priority Data

Oct. 23, 2007 (TW) ..... 96139690 A

(51) Int. Cl.
*H01Q 15/08* (2006.01)

(52) U.S. Cl. ..... 343/911 R

(58) Field of Classification Search ..... 343/911 R, 343/700 MS, 789, 846–848
See application file for complete search history.

(56) References Cited

U.S. PATENT DOCUMENTS

| | | | | |
|---|---|---|---|---|
| 5,453,754 | A * | 9/1995 | Fray | 343/789 |
| 5,952,972 | A * | 9/1999 | Ittipiboon et al. | 343/700 MS |
| 6,700,539 | B2 * | 3/2004 | Lim | 343/700 MS |
| 6,903,692 | B2 * | 6/2005 | Kivekas et al. | 343/702 |
| 6,995,713 | B2 | 2/2006 | Le Bolzer et al. | |
| 7,196,663 | B2 | 3/2007 | Bolzer et al. | |
| 7,504,721 | B2 * | 3/2009 | Chen et al. | 257/724 |
| 7,710,325 | B2 * | 5/2010 | Cheng | 343/700 MS |

FOREIGN PATENT DOCUMENTS

JP 2005142864 6/2005

* cited by examiner

*Primary Examiner* — Huedung Mancuso
(74) *Attorney, Agent, or Firm* — Rabin & Berdo, P.C.

(57) ABSTRACT

The present invention relates to a dielectric resonator antenna (DRA) with bending metallic planes. The ground plane of the dielectric resonator antenna is bent around the DRA to increase the half-power beam width (HPBW) and the gain on H-plane, moreover, to improve the pattern on E-plane. The ground plane of the invention is further bent in different angles to reshape the radiation pattern of the dielectric resonator antenna, and a well is carved in the dielectric resonator antenna to increase its radiation bandwidth. The invention can also be adjusted as WiMAX sectorial antenna.

15 Claims, 4 Drawing Sheets

DIELECTRIC RESONATOR ANTENNA WITH BENDING METALLIC PLANES

FIELD OF THE INVENTION

The present invention is related to a dielectric resonator antenna (DRA), and more particularly, to a dielectric resonator antenna with a carved-well dielectric resonator and plurality of ground metallic planes bent in different angles.

BACKGROUND OF THE INVENTION

The prior rectangle DRA is usually operated in a $TE_{111}$ mode, and the mode has a wide-beam linearly-polarized radiation pattern with a bandwidth of approximately 6-10% and having advantages of low loss and high radiation efficiency, and could be increased to more than 10% by using low-permittivity material with $\epsilon_r \leqq 10$.

The beamwidth of the broadside radiation for a typical sectorial antenna is about 120°, and the half-power beamwidth (HPBW) of vertical polarization on H-plane is only about 80°, can not fulfill the requirement of the sectorial antenna.

As known, the quality factor is an important parameter to affect the bandwidth. Besides, various radiation patterns can be obtained by choosing proper resonator shapes and exciting proper resonant modes, and the radiation efficiency can be affected by the shape of the ground plane, for example, a W-shaped or a V-shaped ground plane is used to lower the cross-polarization level or to increase the gain of antenna. Bigger ground plane can be attached to antennas to increase the gain and to decrease the backward radiation. A ground plane of pyramidal-horn shape has also been used to increase the gain of antenna.

U.S. Pat. No. 6,995,713 published on Feb. 7, 2006, entitled "Dielectric resonator wideband antennas" discloses a wideband antenna consisting of a dielectric resonator or DRA mounted on a substrate with an earth plane, applied to wireless networks, and the resonator is positioned at a distance x from at least one of the edges of the earth plane, x being chosen such that $0 \leqq x \leqq \lambda_{diel}/2$ with $\lambda_{diel}$ the wavelength in the dielectric of the resonator.

U.S. Pat. No. 7,196,663 published on Mar. 27, 2007 entitled "Dielectric resonator type antennas", applied in particular to DRA antennas for domestic wireless networks, relates to a dielectric resonator antenna comprising a block of dielectric material of which a first face intended to be mounted on an earth plane is covered with a metallic layer, and at least one second face perpendicular to the first face is covered with a partial metallic layer having a width less than the width of this second face.

JP Pub. No. 2005142864 published on Jun. 2, 2005 entitled "Dielectric resonator antenna" provided a dielectric resonant antenna whose band is widened. The resonant antenna has a dielectric resonator in a specified shape, a mount substrate where a feeder and ground electrodes are formed and the dielectric resonator is mounted, a loop as a conductor line which is formed on a flank of the dielectric resonator and annularly bent while having one end as a first connection point connected to the feeder and the other end as a second connection point connected to the ground electrodes, and a stub which is formed of a conductor extending from the loop of the dielectric resonator separately from the mount substrate. The first connection point is formed closer to the side of the stub than the second connection point, and a patch is formed on the top surface of the dielectric resonator by patterning a metal conductor in a specified shape.

The above-mentioned DRAs, U.S. Pat. No. 6,995,713 "Dielectric resonator wideband antenna", U.S. Pat. No. 7,196,663 "Dielectric resonator type antennas", and JP Pub. No. 2005142864 "Dielectric resonator antenna", all related to a rectangle DRA, utilize different ways to increase the bandwidth, for example, stacking different size of resonators or reshaping resonators. However, it will make the process more complex, increase cost and the size of the antenna.

SUMMARY OF THE INVENTION

According to the prior arts mentioned above, the main objective of present invention is to provide a dielectric resonator antenna with bending metallic planes, comprises: a substrate, having a first surface and a second surface; a feed conductor, formed on the first surface; a ground plane, formed on the second surface; a resonator of dielectric material mounted on the ground plane; and four metallic planes, attached around the ground plane respectively and electrically connected with the ground plane, wherein the metallic planes form an acute angle with an extended area of the ground plane.

Accordingly, the other objective of present invention is to provide a wide-beam DRA having linear-polarization radiation pattern by attaching metallic planes around a ground plane to increase HPBW and gain on H-plane, moreover, to reshape the pattern on the E-plane.

Furthermore, another objective of the present invention is to increase the HPBW of vertical-polarization radiation pattern and gain on H-plane by adjusting the radiation direction of the electromagnetic wave and concentrating the radiation on the H-plane.

The present invention also provides a method to increase the HPBW of vertical-polarization radiation pattern and the gain on H-plane of the DRA.

Furthermore, the metallic planes attached around the ground plane of the DRA could be adjusted such that the angle between the metallic planes and the ground plane approaches 90° to reflect the electromagnetic wave from different directions and decrease the effective aperture area to board the HPBW of vertical-polarization radiation pattern and gain on H-plane.

BRIEF DESCRIPTION OF THE DRAWINGS

The foregoing aspects, as well as many of the attendant advantages and features of this invention will become more apparent by reference to the following detailed description, when taken in conjunction with the accompanying drawings, wherein.

DESCRIPTION OF THE PREFERRED EMBODIMENT

Figure 1:
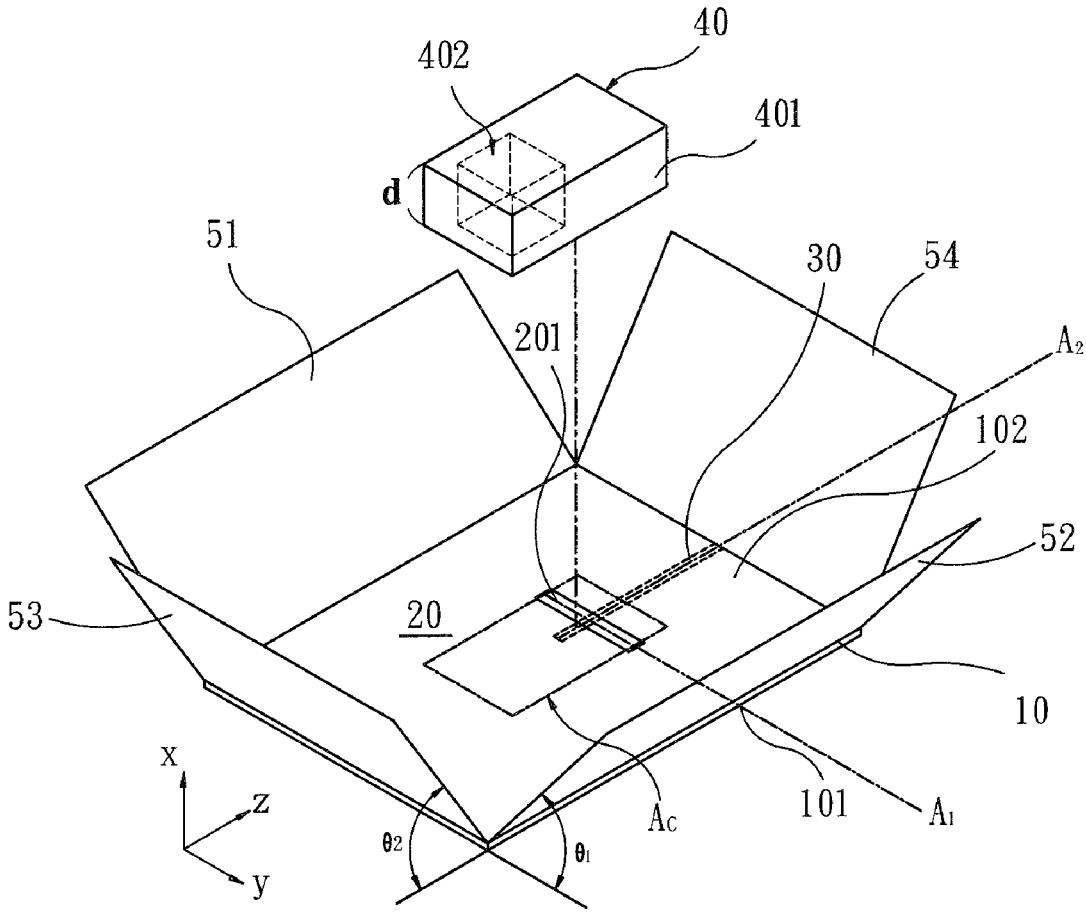
FIG. 1 is a perspective view in accordance with the present invention.

With reference to FIG. 1, illustrating the perspective view, the present invention of the DRA 1 with bending metallic planes, comprises:

a dielectric substrate 10 of plate shape including a first surface 101 and a second surface 102, which is a printed circuit board made of a material having a dielectric constant of 2-13, for example, an FR4 substrate with the dielectric constant of 4.4;

a ground plane 20 of metallic material forming on the second surface 102, and further including a rectangular hollow portion 201, of which the longer side extends along a first axis A1;

a feed conductor 30 mounted on the first surface 101, and the feed conductor 30 extends along a second axis A2 perpendicular to the first axis A1 and pass through the central part of the hollow portion 201, a resonator 40 of dielectric material, further including a main body 401 and a caved well 402. The material of the resonator 40 provides the characteristics of high dielectric constant between 10 to 100 and low loss tangent of about 0.002 to product high radiation efficiency. The main body 401 is shaped as rectangle and partially overlapped with the hollow portion 201. The well 402 is also shaped as rectangle, wherein two of the symmetry sides are parallel to the first axis $A_1$ and the other two symmetry sides are parallel to the second axis $A_2$. Besides, the well 402 could be chosen to overlap with the hollow portion 201 or lapse from the hollow portion 201. The direction of longer side of the main body 401 is the same as the second axis $A_2$. The main body 401 and the ground plane 20 have a contact area Ac, and the second axis A2 pass through the central part of the contact area Ac; and four metallic planes, defined as a first metallic plane 51, a second metallic plane 52, a third metallic plane 53 and a forth metallic plane 54, attached around the ground plane 20 and electrically interconnected with the ground plane 20, wherein the metallic planes form an acute angle with the extended area of the ground plane 20. The angle between the extend area of the ground plane 20 and the first metallic plane 51 or the second metallic plane 52 is defined as a first acute angle $\theta_1$, and the angle between the extend area of the ground plane 20 and the third metallic plane 53 or the forth metallic plane 54 is defined as a second acute angle $\theta_2$.

Moreover, the first metallic plane 51 and the second metallic plane 52 are attached on the sides of the ground plane 20 in z-direction, and the third metallic plane 53 and the fourth metallic plane 54 are attached on the sides of the ground plane 20 in y-direction.

Figure 4:
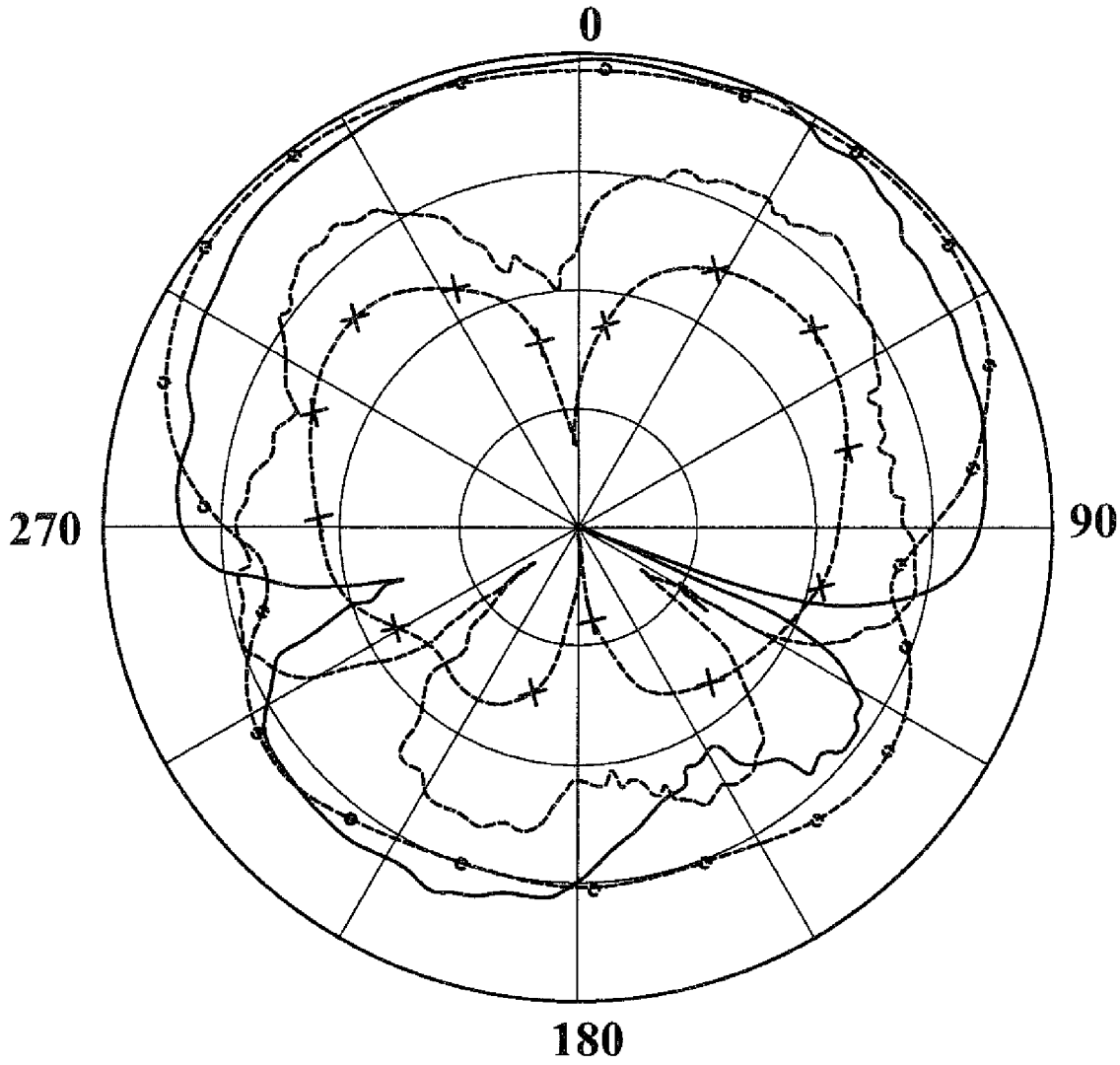
FIG. 4 is a radiation pattern diagram of the dielectric resonator antenna according to the embodiment of the present invention.

Besides, the present invention reshapes the radiation pattern by reflecting the electromagnetic wave between the metallic planes 51-54, through bending the first metallic plane 51 and the second metallic plane 52 to adjust the angle $\theta_1$ to increase the HPBW of vertical polarization. FIG. 4 shows the radiation pattern on the xy-plane at frequency 3.4 GHz. The solid line is the measured vertical-polarization pattern and the dash line is the measured horizontal-polarization pattern. While $\theta_1$ approaches 90°, the HPBW of vertical-polarization radiation pattern on H-plane (xy-plane) is about 120°.

On the other hand, adjusting the third metallic plane 53 and the fourth metallic plane 54 to change the angle $\theta_2$ to concentrate the radiation on the H-plane.

The dielectric resonator antenna of present invention has properties of low loss and of vertically-polarized radiation pattern to apply in the WiMAX networks.

In addition, it should be noted that some performance of the DRA 1 provided by the present invention can be controlled by adjusting related elements. For example, (1) the position of the dielectric resonator 40 is fine-adjusted to match with input impedance, (2) the size of the main body 401 is adjusted to adjust the resonant frequency of the DRA, (3) the position and size of the well 402 is adjusted to fine-adjust resonant frequency of the DRA and to increase the radiation bandwidth, (4) the angle $\theta_1$ is adjusted to increase the HPWB of vertical polarization on the H plane, and (5) the angle $\theta_2$ is adjusted to increase the HPWB of vertical polarization on the H plane.

Figure 2:
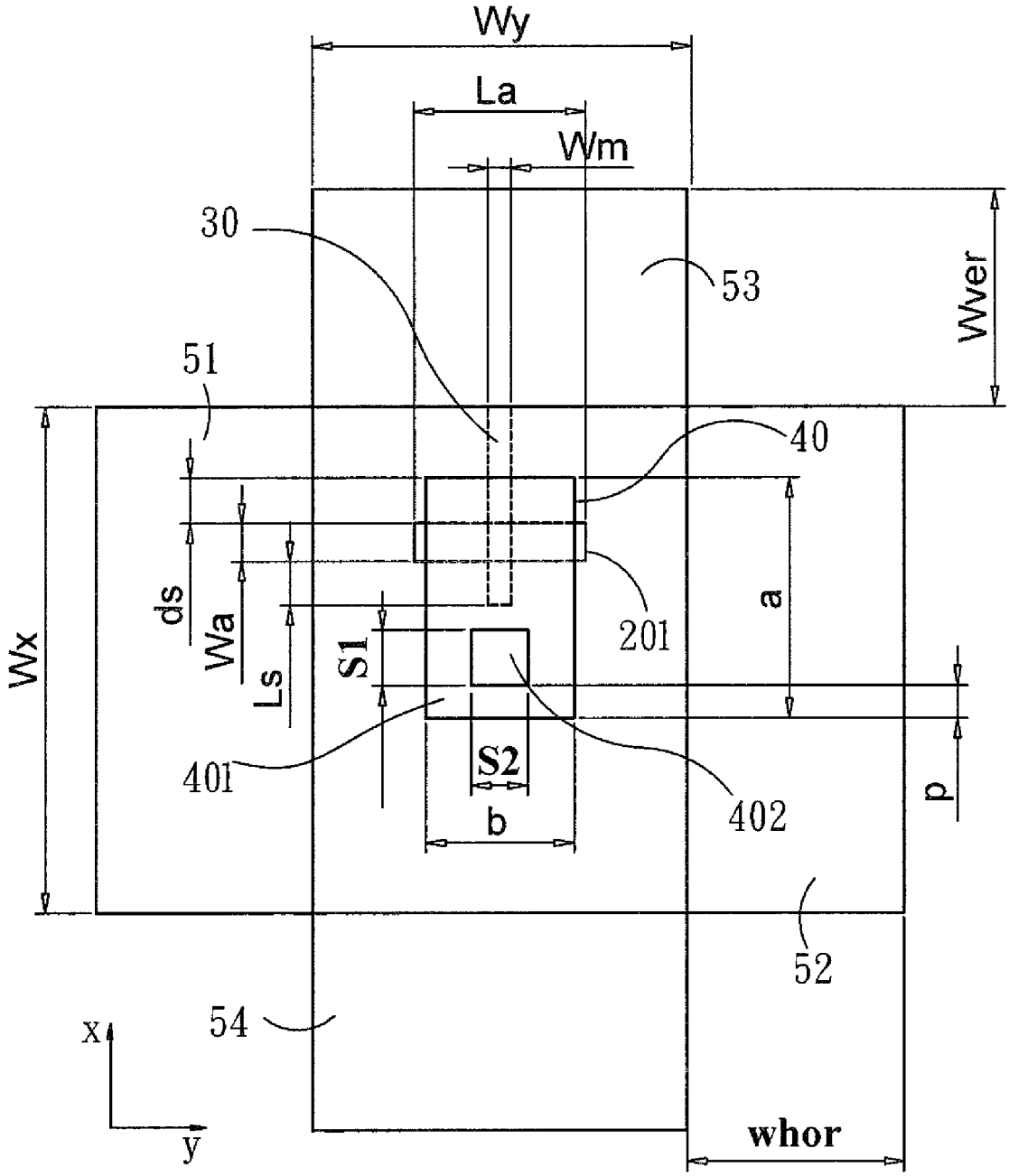
FIG. 2 is a diagram illustrating the size of different parts of the present invention.

FIG. 2 is a plan diagram illustrating the size of different parts of the present invention. Sizes of different parts of the DRA 1 are given as follows. The main body 401 has a length a, a width b, a height d (shown in FIG. 1), and a distance between the edge of the well and the main body is p. The well 402 has a length and a width S1 and S2 respectively. The substrate 10 and the ground plane 20 have a length $W_x$ and a width $W_y$. The width of the feed conductor 30 is Wm, and the length of the feed conductor 30 extended beyond the hollow portion 201 is Ls. The hollow portion 201 has a length La and a width $W_a$. The length and the width of the first metallic plane 51 and the second metallic plane 52 are $W_x$ and $W_{hor}$, respectively. And the length and the width of the third metallic plane 53 and the fourth metallic plane 54 are $W_y$ and $W_{ver}$, respectively.

Next, sizes of different parts of the DRA 1 are given as follows. The main body 401 has a length a, a width b, a height d, a distance between the edge of the well and the main body is p and the well 402 has a length $S_1$ and a width $S_2$, wherein a=21 mm, b=13.5 mm, d=9.7 mm, p=8.5 mm, $S_1$=5.4 mm, and $S_2$=9.1 mm. The length and the width of the hollow portion 201 are $W_a$=1 mm, and $L_a$=12.5 mm. The lengths and widths of the substrate 10 and the ground plane 20 are $W_x$=80 mm and $W_y$=55 mm. The thinness of the substrate is t=0.6 mm, the dielectric constant is 4.4, and the dielectric constant $\epsilon_r$ of the dielectric resonator 40 is 20. Moreover, the relative distance of the edge of the resonator 40 to the hollow portion 201 is $d_s$=2.6 mm. The distance of the feed conductor 30 extended beyond the hollow portion 201 is Ls=3 mm. The size of the metallic plane is $W_{hor}$=$E_{ver}$=60 mm, the angles are $\theta_1$=85°, and $\theta_2$=75°.

Figure 3:
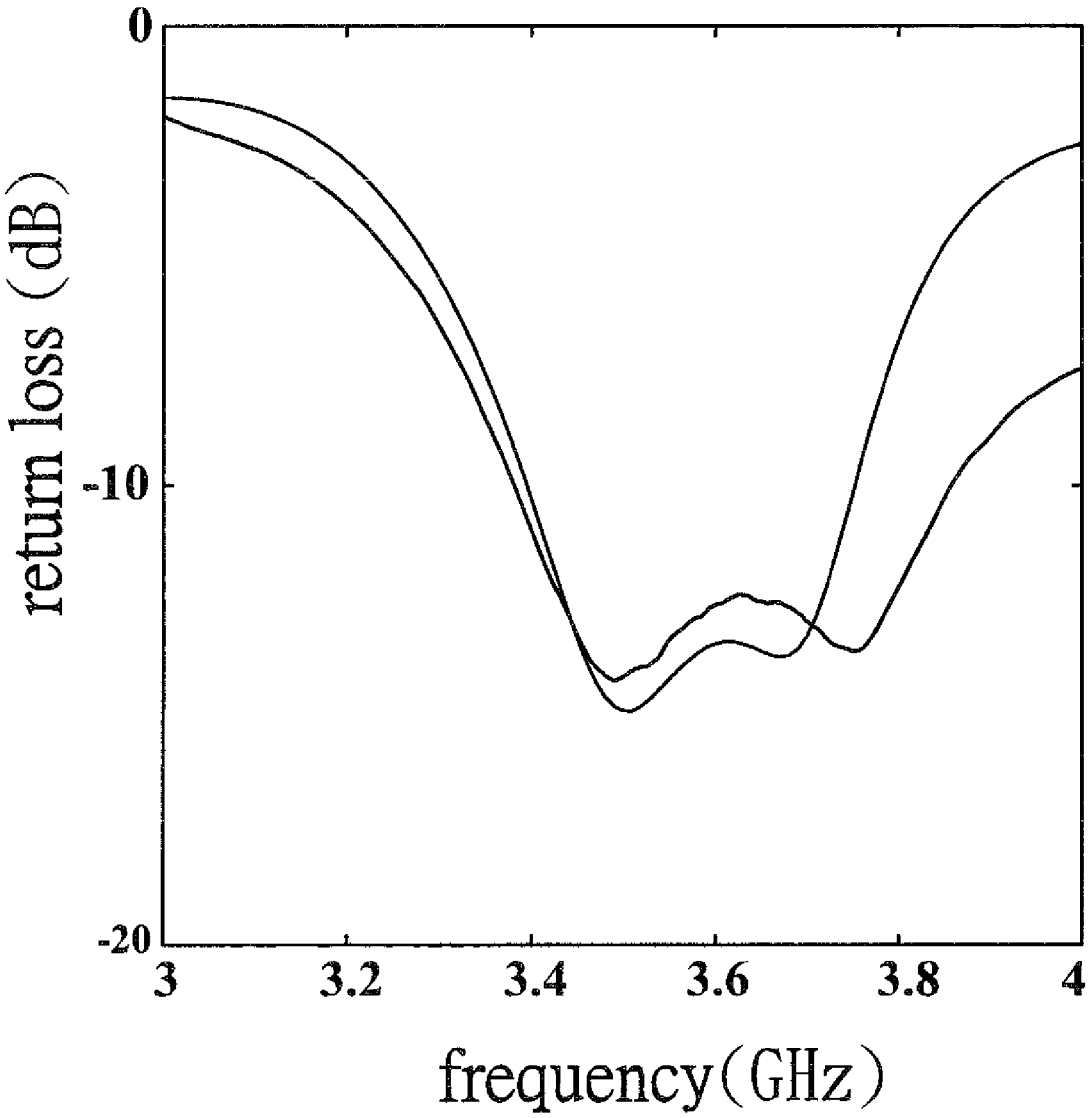
FIG. 3 is a diagram illustrating return loss of the signal transmission of the dielectric resonator antenna according to the embodiment of the present invention.

According to the preferred embodiment of the present invention, the return loss is smaller when the bandwidth is between 3.4-3.8 GHz as shown in FIG. 3. FIG. 4 shows the radiation pattern on x-y plane at frequency 3.4 GHz. The solid line is the measured vertical-polarization pattern and the dash line is the measured horizontal-polarization pattern.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A dielectric resonator antenna with bending metallic planes, comprises:

a substrate, having a first surface and a second surface;

a feed conductor, formed on the first surface;

a ground plane, formed on the second surface;

a resonator of dielectric material mounted on the ground plane; and four metallic planes, attached around the ground plane respectively and electrically connected with the ground plane, wherein the metallic planes form an acute angle with an extended area of the ground plane.

2. The dielectric resonator antenna as claimed in claim 1, wherein the ground plane is a metallic plane.

3. The dielectric resonator antenna as claimed in claim 1, wherein the ground plane having a hollow portion extended along a first axis (A1), and the feed conductor extended along a second axis (A2) and passing through the central part of the hollow portion.

4. The dielectric resonator antenna as claimed in claim 3, wherein the hollow portion is shaped as a rectangle and the longer side of the hollow portion is extended along the first axis.

5. The dielectric resonator antenna as claimed in claim 3, wherein the first axial (A1) is perpendicular to the second axial (A2).

6. The dielectric resonator antenna as claimed in claim 3, wherein the resonator partially covers the hollow portion.

7. The dielectric resonator antenna as claimed in claim 6, wherein the resonator further consists of a main body and a caved well.

8. The dielectric resonator antenna as claimed in claim 7, wherein the main body and the well are shaped as a rectangle.

9. The dielectric resonator antenna as claimed in claim 7, wherein the main body extends along the second axis.

10. The dielectric resonator antenna as claimed in claim 7, wherein the well does not overlap with the hollow portion, and is close to the other side along the longer side of the main body.

11. The dielectric resonator antenna as claimed in claim 7, wherein the main body is positioned on a contacted area of the ground plane, and the second axis passes through the central part of the contacted area.

12. The dielectric resonator antenna as claimed in claim 1, wherein the conductor extends along the second axis.

13. The dielectric resonator antenna as claimed in claim 12, wherein the four metallic planes include a first metallic plane, a second metallic plane, a third metallic plane, and a fourth metallic plane, wherein the first metallic plane and the second metallic plane are attached to the ground plane and paralleled to the second axial, and wherein the third metallic plane and the fourth metallic plane are attached to the ground plane and paralleled to the first axis.

14. The dielectric resonator antenna as claimed in claim 13, wherein the first metallic plane or the second metallic plane forms a first acute angle $\theta_1$ with the extended area of the ground plane.

15. The dielectric resonator antenna as claimed in claim 13, wherein the third metallic plane or the fourth metallic plane forms a second acute angle $\theta_2$ with the extended area of the ground plane.

* * * * *